US009962941B2

(12) United States Patent
Hiramoto

(10) Patent No.: US 9,962,941 B2
(45) Date of Patent: May 8, 2018

(54) RECORDING APPARATUS AND STORAGE METHOD

(71) Applicant: SEIKO EPSON CORPORATION, Tokyo (JP)

(72) Inventor: Goki Hiramoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/404,276

(22) Filed: Jan. 12, 2017

(65) Prior Publication Data

US 2017/0203573 A1 Jul. 20, 2017

(30) Foreign Application Priority Data

Jan. 19, 2016 (JP) ..... 2016-008074

(51) Int. Cl.

| | |
|---|---|
| ***B41J 2/165*** | (2006.01) |
| ***B41J 2/17*** | (2006.01) |
| ***B41J 2/175*** | (2006.01) |
| ***B41J 2/185*** | (2006.01) |
| ***B41J 29/38*** | (2006.01) |

(52) U.S. Cl.

CPC ..... *B41J 2/16552* (2013.01); *B41J 2/1652* (2013.01); *B41J 2/16508* (2013.01); *B41J 2/16517* (2013.01); *B41J 2/16523* (2013.01); *B41J 2/16532* (2013.01); *B41J 2/175* (2013.01); *B41J 2/1714* (2013.01); *B41J 2/185* (2013.01); *B41J 29/38* (2013.01); *B41J 2002/16573* (2013.01)

(58) Field of Classification Search

CPC ..... B41J 2/16552; B41J 2/16523
USPC ..... 347/28
See application file for complete search history.

(56) References Cited

U.S. PATENT DOCUMENTS

| | | | | |
|---|---|---|---|---|
| 7,213,902 | B2 | 5/2007 | DeVivo et al. | |
| 2001/0028374 | A1* | 10/2001 | Ogawa | B41J 2/16532 347/35 |
| 2002/0175969 | A1 | 11/2002 | Suzuki | |
| 2003/0081046 | A1* | 5/2003 | Enz | B41J 2/02 347/25 |
| 2009/0115815 | A1* | 5/2009 | Uda | B41J 2/16552 347/28 |

FOREIGN PATENT DOCUMENTS

| | | | |
|---|---|---|---|
| JP | 2002-192710 | A | 7/2002 |
| JP | 2008-272996 | A | 11/2008 |
| JP | 2010-120266 | A | 6/2010 |
| WO | 2008/084690 | A1 | 7/2008 |

OTHER PUBLICATIONS

The Extended European Search Report for the corresponding European Application No. 17152157.8 dated Apr. 24, 2017.

* cited by examiner

*Primary Examiner* — Huan Tran
*Assistant Examiner* — Alexander D Shenderov

(57) ABSTRACT

A recording apparatus includes a discharge section configured to discharge an ink from a nozzle onto a medium, a common flow path configured to supply a liquid to the nozzle, an ink supply path configured to supply the ink to the common flow path, filling liquid supply paths configured to supply a filling liquid to the common flow path, an air release path configured to release air in the common flow path, and a switching between section configured to switch the opening and closing of the ink supply path, the filling liquid supply paths, and the air release path.

8 Claims, 5 Drawing Sheets

RECORDING APPARATUS AND STORAGE METHOD

BACKGROUND

1. Technical Field

The present invention relates a recording apparatus and a storage method.

2. Related Art

Recording apparatuses that discharge ink onto a medium for recording have been used. Generally, such recording apparatuses have a cap to cover a discharge section (nozzle) so as to prevent drying of ink in the nozzle in the discharge section. For example, JP-A-2010-120266 and JP-A-2008-272996 disclose recording apparatuses that have a cap to cover a discharge section (nozzle).

In recent recording apparatuses that discharge ink onto a medium for recording, various kinds of inks are used, and in some cases, solid materials in these inks are deposited on the nozzle and other parts and may cause ink clogging during storage of the recording apparatuses. The recording apparatus disclosed in JP-A-2008-272996 has a structure capable of supplying a cleaning liquid to a nozzle, however, depending on the type of the ink being used, it is difficult to discharge the ink from the nozzle. In such a case, the ink and the cleaning liquid may be mixed in the nozzle (the ink is not sufficiently replaced with the cleaning liquid), and this mixture may cause ink clogging.

SUMMARY

An advantage of some aspects of the invention is that ink clogging is reduced.

A recording apparatus according to a first aspect of the invention for solving the above-described problem includes a discharge section configured to discharge an ink from a nozzle onto a medium, a common flow path configured to supply a liquid to the nozzle, an ink supply path configured to supply the ink to the common flow path, a filling liquid supply path configured to supply a filling liquid to the common flow path, an air release path configured to release air in the common flow path, and a switching section configured to switch between the opening and closing of the ink supply path, the filling liquid supply path, and the air release path.

According to this aspect, together with the ink supply path and the filling liquid supply path, the air release path is provided and the opening and closing of the ink supply path, the filling liquid supply path, and the air release path can be switched. With this structure, when the ink is fully supplied from the common flow path to the nozzle, the recording apparatus can discharge the ink once, and then supply the filling liquid from the common flow path to the nozzle. Accordingly, the efficiency in replacing the ink with the filling liquid can be increased, and the efficiency in cleaning from the common flow path to the nozzle can be increased, and thereby ink clogging in the nozzle and other parts can be reduced.

The recording apparatus according to a second aspect of the invention includes, in the first aspect, a cleaning liquid supply path for a cleaning liquid and a storage liquid supply path for a storage liquid as the filling liquid supply path.

According to this aspect, the cleaning liquid supply path for the cleaning liquid and the storage liquid supply path for the storage liquid are provided as the filling liquid supply path. Accordingly, for example, ink contamination can be effectively cleaned with the cleaning liquid that has a strong cleaning power while the path from the common flow path to the nozzle can be effectively moisturized with the less volatile storage liquid and stored.

The recording apparatus according to a third aspect of the invention includes, in the second aspect, a cap configured to cap and suck the nozzle, and a controller configured to control the supply of the liquid to the common flow path and the capping and suction of the nozzle. The controller performs a liquid discharge process of opening the air release path, sucking the nozzle with the cap, and discharging the liquid from the common flow path, a cleaning liquid supply process of closing the air release path, opening the cleaning liquid supply path, and supplying the cleaning liquid from the cleaning liquid supply path to the nozzle through the common flow path until the nozzle is filled with the cleaning liquid, a cleaning liquid discharge process of opening the air release path, sucking the nozzle with the cap, and discharging the cleaning liquid from the common flow path, and a storage liquid supply process of closing the air release path, opening the storage liquid supply path, and supplying the storage liquid from the storage liquid supply path to the nozzle through the common flow path until the nozzle is filled with the storage liquid.

According to this aspect, the recording apparatus performs the liquid discharge process of opening the air release path, and discharging the liquid from the common flow path, the cleaning liquid supply process of supplying the cleaning liquid from the cleaning liquid supply path to the nozzle through the common flow path until the nozzle is filled with the cleaning liquid, the cleaning liquid discharge process of opening the air release path and discharging the cleaning liquid from the common flow path, and the storage liquid supply process of supplying the storage liquid from the storage liquid supply path to the nozzle through the common flow path until the nozzle is filled with the storage liquid. That is, for example, to store the recording apparatus, the air release path is opened to discharge the liquid once to replace the liquid (for example, replace the ink with the cleaning liquid, and replace the cleaning liquid with the storage liquid), and thereby the replacement efficiency can be increased, and furthermore, the cleaning is performed first using the cleaning liquid and then the storage liquid is supplied, and thereby the efficiency in replacing, in particular, the ink with the storage liquid can be increased. Accordingly, for example, when the recording apparatus is stored, in particular, ink clogging in the nozzle and other parts can be reduced.

In the recording apparatus according to a fourth aspect of the invention, in the third aspect, the controller performs, in response to a recording start after the execution of the storage liquid supply process, a storage liquid discharge process of opening the air release path, sucking the nozzle with the cap, and discharging the storage liquid from the common flow path, and an ink supply process of closing the air release path, opening the ink supply path, and supplying the ink from the ink supply path to the nozzle through the common flow path until the nozzle is filled with the ink.

According to this aspect, in response to a recording start after the execution of the storage liquid supply process, the storage liquid discharge process of discharging the storage liquid from the common flow path while the air release path is opened, and the ink supply process of closing the air release path, opening the ink supply path, and supplying the ink from the ink supply path to the nozzle through the common flow path until the nozzle is filled with the ink are performed. That is, when recording is started, the air release path is opened to discharge the storage liquid once, and the storage liquid is replaced with the ink, and thereby the replacement efficiency can be increased. Accordingly, in the recording start process, negative effects, such as thinning of the ink caused by the mixing of the ink with the storage liquid can be reduced.

In the recording apparatus according to a fifth aspect of the invention, in the third aspect, the controller performs the liquid discharge process, the cleaning liquid supply process, the cleaning liquid discharge process, and the storage liquid supply process, in response to an input of an instruction to turn off the power of the recording apparatus.

According to this aspect, in response to an input of an instruction to turn off the power of the recording apparatus, the liquid discharge process, the cleaning liquid supply process, the cleaning liquid discharge process, and the storage liquid supply process are performed. Consequently, each of the processes can be automatically performed, and the user can be prevented from forgetting to issue an instruction to execute these processes.

The recording apparatus according to a sixth aspect of the invention includes, in the third aspect, an execution start reception section configured to start the execution of the liquid discharge process, the cleaning liquid supply process, the cleaning liquid discharge process, and the storage liquid supply process by the controller.

According to this aspect, the execution start reception section configured to start the execution of the liquid discharge process, the cleaning liquid supply process, the cleaning liquid discharge process, and the storage liquid supply process is provided. Consequently, the user can instruct the execution of these processes at an appropriate time.

According to a seventh aspect of the invention, in the first aspect, the filling liquid contains a component contained in the ink.

According to this aspect, the filling liquid contains a component contained in the ink. Consequently, negative effects that may occur when the filling liquid is mixed with the ink can be reduced.

According to an eighth aspect of the invention, there is provided a method of storing a recording apparatus including a discharge section configured to discharge an ink from a nozzle onto a medium, a common flow path configured to supply a liquid to the nozzle, an ink supply path configured to supply the ink to the common flow path, a filling liquid supply path configured to supply a filling liquid to the common flow path, an air release path configured to release air in the common flow path, a switching section configured to switch between the opening and closing of the ink supply path, the filling liquid supply path, and the air release path, and a cap configured to cap and suck the nozzle. The method includes a liquid discharge process of opening the air release path, sucking the nozzle with the cap, and discharging the liquid from the common flow path, a cleaning liquid supply process of closing the air release path, opening the cleaning liquid supply path, and supplying the cleaning liquid from the cleaning liquid supply path to the nozzle through the common flow path until the nozzle is filled with the cleaning liquid, a cleaning liquid discharge process of opening the air release path, sucking the nozzle with the cap, and discharging the cleaning liquid from the common flow path, and a storage liquid supply process of closing the air release path, opening the storage liquid supply path, and supplying the storage liquid from the storage liquid supply path to the nozzle through the common flow path until the nozzle is filled with the storage liquid.

According to this aspect, the liquid discharge process of opening the air release path, and discharging the liquid from the common flow path, the cleaning liquid supply process of supplying the cleaning liquid from the cleaning liquid supply path to the nozzle through the common flow path until the nozzle is filled with the cleaning liquid, the cleaning liquid discharge process of opening the air release path and discharging the cleaning liquid from the common flow path, and the storage liquid supply process of supplying the storage liquid from the storage liquid supply path to the nozzle through the common flow path until the nozzle is filled with the storage liquid are performed. That is, for example, to store the recording apparatus, the air release path is opened to discharge the liquid once to replace the liquid (for example, replace the ink with the cleaning liquid, and replace the cleaning liquid with the storage liquid), and thereby the replacement efficiency can be increased, and furthermore, the cleaning is performed first using the cleaning liquid and then the storage liquid is supplied, and thereby the efficiency in replacing, in particular, the ink with the storage liquid can be increased. Accordingly, for example, when the recording apparatus is stored, in particular, ink clogging in the nozzle and other parts can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
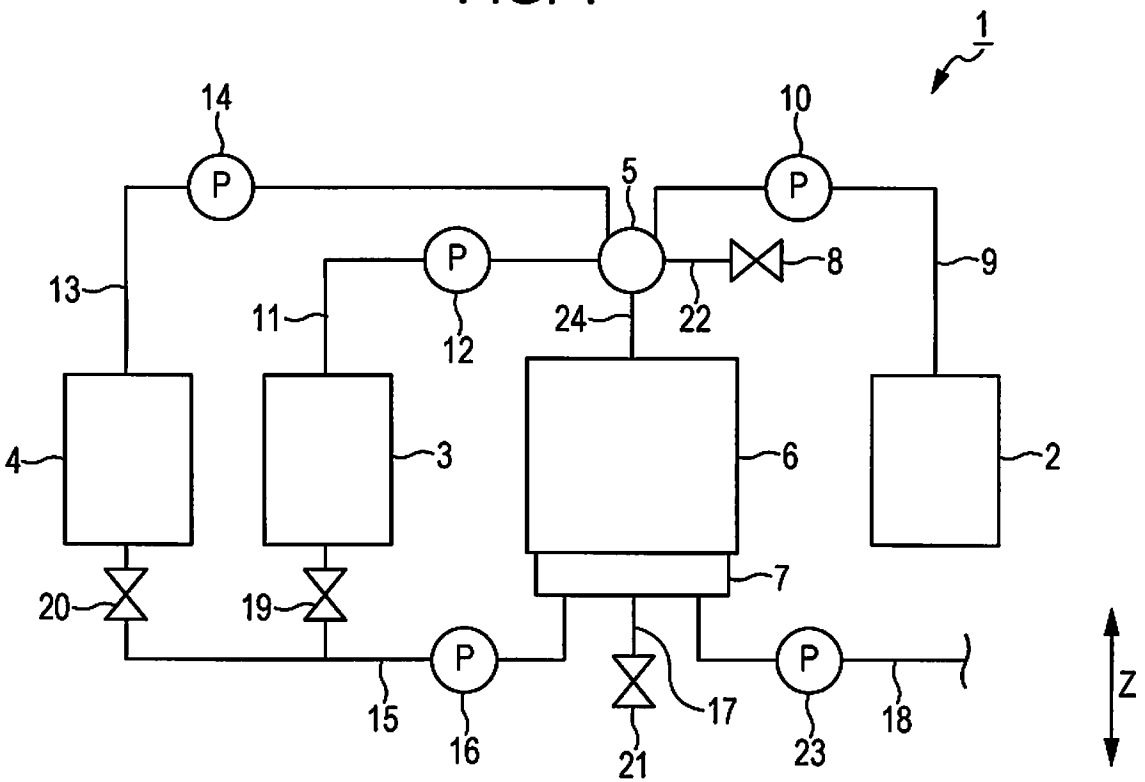
FIG. 1 is a schematic diagram of a recording apparatus according to an embodiment of the invention.

Hereinafter, a recording apparatus according to an embodiment of the invention will be described with reference to the attached drawings. First, a recording apparatus 1 according to the embodiment of the invention is briefly described. FIG. 1 is a schematic diagram of the recording apparatus 1 according to the embodiment.

As illustrated in FIG. 1, the recording apparatus 1 according to the embodiment includes an ink tank 2 that stores an ink, and a recording head 6 that serves as a discharge section that discharges the ink from a nozzle. The ink tank 2 and the recording head 6 are connected to each other via an ink supply path 9 and a common flow path 24. In the ink supply path 9, a pump 10 that forces the ink to flow from the side of the ink tank 2 to the side of the recording head 6 is provided.

The recording apparatus 1 according to the embodiment includes a cap 7 that caps a nozzle formation surface of the recording head 6. FIG. 1 illustrates the nozzle of the recording head 6 capped by the cap 7. The recording head 6 can move in directions Z with respect to the cap 7, and the recording head 6 is brought into contact with the cap 7 so as to be capped by the cap 7. The recording head 6 is separated from the cap 7 so as to be released from the covered state. The cap 7 is connected to an air release path 17 that has an air release valve 21, a discharge path 18 capable of discharging a liquid in the cap 7 by actuating a pump 23, and a supply path 15 capable of supplying a filling liquid, which will be described below, into the cap 7 by actuating a pump 16.

The recording head 6 and the cap 7 can be filled with the filling liquid in the recording apparatus 1 according to the embodiment. The filling liquid includes a cleaning liquid and a storage liquid, and the recording head 6 and the cap 7 can be filled with these liquids. Specifically, as illustrated in FIG. 1, the recording apparatus 1 according to the embodiment includes a cleaning liquid tank 3 that stores the cleaning liquid and a storage liquid tank 4 that stores the storage liquid. The cleaning liquid tank 3 is connected to the recording head 6 via a cleaning liquid supply path (filling liquid supply path) 11 and the common flow path 24, and is also connected to the cap 7 via an opening/closing valve 19 and a supply path 15. The storage liquid tank 4 is connected to the recording head 6 via a storage liquid supply path (filling liquid supply path) 13 and the common flow path 24, and is also connected to the cap 7 via an opening/closing valve 20 and the supply path 15. In the cleaning liquid supply path 11, a pump 12 that forces the cleaning liquid to flow from the side of the cleaning liquid tank 3 to the side of the recording head 6 is provided. In the storage liquid supply path 13, a pump 14 that forces the storage liquid to flow from the side of the storage liquid tank 4 to the side of the recording head 6 is provided.

The common flow path 24 is connected, via a valve 5, to the ink supply path 9, the cleaning liquid supply path 11, the storage liquid supply path 13, and an air release path 22 that has an air release valve 8. The valve 5 opens and closes the common flow path 24, the ink supply path 9, the cleaning liquid supply path 11, the storage liquid supply path 13, and the air release path 22. The recording apparatus 1 according to the embodiment having such a structure regulates the valve 5 and the pumps 10, 12, 14, and 23 such that the recording head 6 is supplied with the ink, the cleaning liquid, the storage liquid, or air.

It should be noted that the structure of the recording apparatus 1 is not limited to the structure according to the embodiment. For example, opening/closing valves may be provided instead of the pumps 10, 12, 14, and 16 and by controlling opening/closing operations of the opening/closing valves, whether to perform or not to perform a capping operation (operation of moving the recording head 6 in the Z directions), and an on/off operation of actuation of the pump 23, supply and discharge of a liquid to the recording head 6 and the cap 7 may be performed. Alternatively, a pump may be provided in the common flow path 24 instead of the pumps 10, 12, and 14. Furthermore, a cleaning liquid and a storage liquid, which serve as a filling liquid, may be combined together as a cleaning-storage liquid, and one of a unit consisting of the cleaning liquid tank 3, the cleaning liquid supply path 11, the pump 12, and an opening/closing valve 19, and a unit consisting of the storage liquid tank 4, the storage liquid supply path 13, the pump 14, and an opening/closing valve 20, may be omitted.

Figure 2:
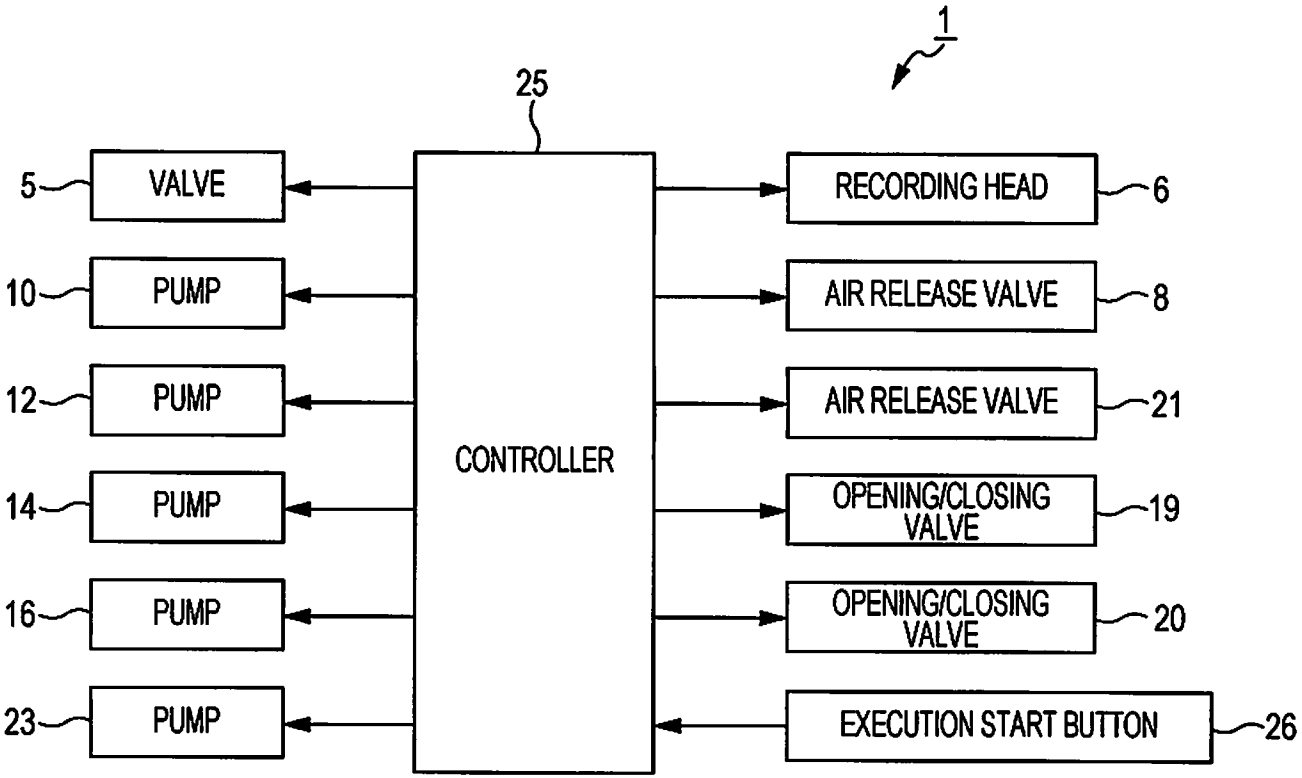
FIG. 2 is a block diagram of the recording apparatus according to the embodiment of the invention.

Next, an electric configuration in the recording apparatus 1 according to the embodiment will be described. FIG. 2 is a block diagram of the recording apparatus 1 according to the embodiment. As illustrated in FIG. 2, the recording apparatus 1 according to the embodiment includes a controller 25 that controls components constituting the recording apparatus 1 such as the valve 5, the recording head 6, the pumps 10, 12, 14, 16, and 23, the air release valves 8 and 21, the opening/closing valves 19 and 20, and an execution start button 26, which will be described below. The controller 25 controls driving of the recording head 6 so as to correspond to an ink discharge operation (recording operation). The controller 25 also controls movement of the recording head 6 with respect to the cap 7 in the z directions, opening/closing operations of the valve 5 and the opening/closing valves 19 and 20, and actuation of the pumps 10, 12, 14, 16, and 23 so as to correspond to supply and discharge of a liquid to the recording head 6 and the cap 7. The controller 25 may be a plurality of controllers each performing control of individual corresponding components, or may be a controller that performs overall control of a plurality of components.

As described above, the recording apparatus 1 according to the embodiment includes the recording head 6 that discharges an ink from a nozzle onto a medium, the common flow path 24 that supplies a liquid to the nozzle, the ink supply path 9 that supplies the ink to the common flow path 24, and the filling liquid supply paths 11 and 13 that supply a filling liquid to the common flow path 24. The recording apparatus 1 further includes the air release path 22 that causes the interior of the common flow path 24 to be opened to the atmosphere, the ink supply path 9, the filling liquid supply paths 11 and 13, and the valve 5 that serves as a switching section for switching the opening and closing of the air release path 22. As described above, the recording apparatus 1 according to the embodiment includes the air release path 22 together with the ink supply path 9, and the filling liquid supply paths 11 and 13, and the recording apparatus 1 is capable of switching the opening and closing of the ink supply path 9, the filling liquid supply paths 11 and 13, and the air release path 22. With this structure, when an ink is fully supplied from the common flow path 24 to the nozzle, the recording apparatus 1 can discharge the ink once, and then supply a filling liquid (a cleaning liquid or a storage liquid) from the common flow path 24 to the nozzle. Accordingly, the efficiency in replacing the ink with the filling liquid can be increased, and the efficiency in cleaning from the common flow path 24 to the nozzle can be increased, and thereby ink clogging in the nozzle and other parts can be reduced.

As mentioned above, in the recording apparatus 1 according to the embodiment, the cleaning liquid or the storage liquid can be used as the filling liquid. The cleaning liquid contains a larger amount of solvent, which has a high cleaning power, than the storage liquid, and the storage liquid contains a larger amount of solvent, which has a low volatility, than the cleaning liquid. A higher cleaning power tends to increase the corrosivity to the components, however, in a case where the cleaning liquid comes into contact with the components only for a short time, the corrosivity rarely cause a problem.

In other words, the recording apparatus 1 according to the embodiment includes the cleaning liquid supply path 11 for the cleaning liquid that has a higher cleaning power than that of the storage liquid, and the storage liquid supply path 13 for the storage liquid less volatile than the cleaning liquid. Accordingly, ink contamination can be effectively cleaned with the cleaning liquid that has the strong cleaning power while the path from the common flow path 24 to the nozzle can be effectively moisturized with the less volatile storage liquid and stored.

Figure 3:
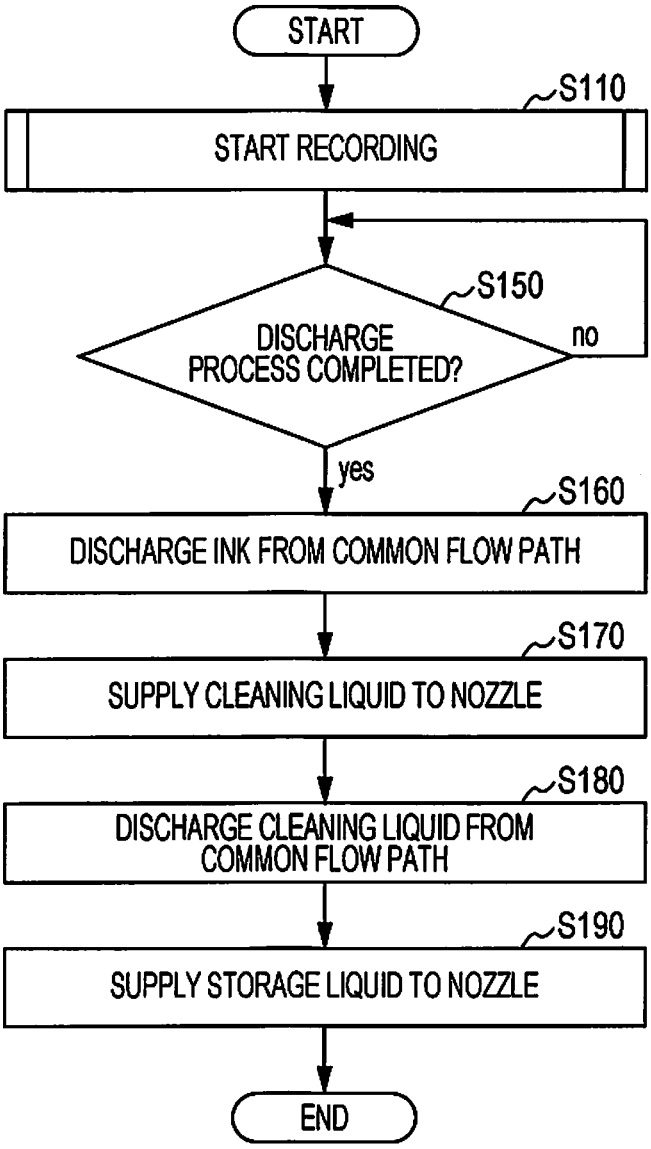
FIG. 3 is a flowchart of a capping method that is performed using the recording apparatus according to the embodiment of the invention.
Figure 4:
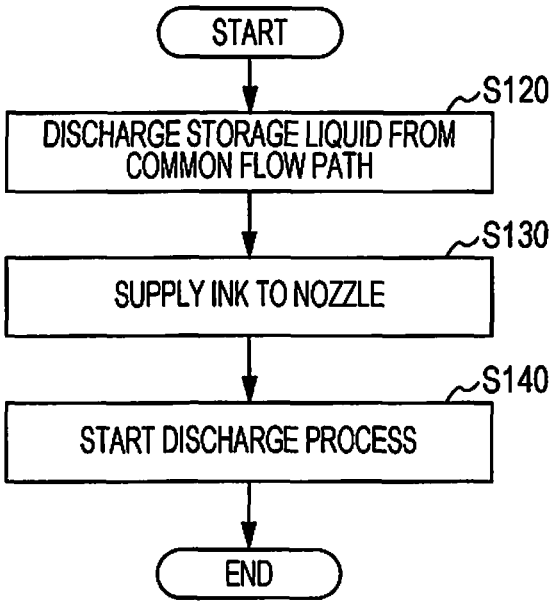
FIG. 4 is a flowchart of processes to be performed at the time of starting the recording in the capping method that is performed using the recording apparatus according to the embodiment of the invention.

Next, a method of storing the recording apparatus 1 according to the embodiment will be described. FIG. 3 is a flowchart showing a storing method according to the embodiment. FIG. 4 is a flowchart of processes to be performed at the time of starting a recording operation in the recording apparatus 1 being stored according to the storage method.

First, in step S110, recording data is input by the controller 25 and recording is started. In step S150, a recording operation is performed until the recording (discharge of the ink) according to the recording data is completed. The process of starting the recording in step S110 is started in a state the recording apparatus 1 is stored according to the following storage method according to the embodiment. The recording start process in step S110 will be described in detail below with reference to FIG. 4.

Upon the completion of the process in step S150, in response to the completion of the recording operation, in step S160, the controller 25 regulates the valve 5 such that the air release path 22 is opened, and instructs the cap 7 to suck the nozzle to discharge the ink from the common flow path 24, in a liquid discharge process. Specifically, after the controller 25 opens the air release valve 8, the controller 25 regulates the valve 5 such that the air release path 22 is opened, instructs the cap 7 to come into contact with the recording head 6, and actuates the pump 23 such that the liquid (in this process, the ink) is sucked from the nozzle and the liquid (ink) in the common flow path 24 is discharged via the cap 7 and the discharge path 18.

In step S170, in a cleaning liquid supply process, the controller 25 closes at least one of the air release valve 8 and the valve 5 such that the air release path 22 is closed, regulates the valve 5 such that the cleaning liquid supply path 11 is opened, instructs the cap 7 to suck the nozzle, and actuates the pump 12 such that the cleaning liquid is supplied from the cleaning liquid supply path 11 to the nozzle via the common flow path 24 until the nozzle is filled with the cleaning liquid.

In step S180, in a cleaning liquid discharge process, the controller 25 opens the air release valve 8 such that the air release path 22 is opened, and instructs the cap 7 to suck the nozzle to discharge the cleaning liquid from the common flow path 24.

In step S190, in a storage liquid supply process, the controller 25 closes at least one of the air release valve 8 and the valve 5 such that the air release path 22 is closed, regulates the valve 5 such that the storage liquid supply path 13 is opened, instructs the cap 7 to suck the nozzle, and actuates the pump 14 such that the storage liquid is supplied from the storage liquid supply path 13 to the nozzle via the common flow path 24 until the nozzle is filled with the storage liquid. After the completion of the process in step S190, the recording apparatus 1 is stored in this state and thereby the storage method according to the embodiment ends.

According to the storage method according to the embodiment, for example, in order to store the recording apparatus 1, the air release path 22 is opened and the liquid is discharged once and replaced (for example, the ink is replaced with the cleaning liquid, and the cleaning liquid is replaced with the storage liquid), and thereby the replacement efficiency can be increased, and furthermore, first, the cleaning is performed using the cleaning liquid and then the storage liquid is supplied, and thereby the efficiency in replacing, in particular, the ink with the storage liquid can be increased. Accordingly, for example, when the recording apparatus 1 is stored, in particular, ink clogging in the nozzle and other parts can be reduced.

Next, processes to be performed when a recording operation is started in the recording apparatus 1, which has been stored according to the storage method of the above-described embodiment, will be described. FIG. 4 is a flowchart of processes in step S110 (processes to be performed at the time of starting recording after the execution of the storage liquid supply process in step S190) corresponding to processes to be performed at the time of starting a recording operation.

First, in step S120, in a storage liquid discharge process, the controller 25 regulates the air release valve 8 such that the air release path 22 is opened, and instructs the cap 7 to suck the nozzle to discharge the storage liquid from the common flow path 24.

In step S130, in an ink supply process, the controller 25 closes at least one of the air release valve 8 and the valve 5 such that the air release path 22 is closed, regulates the valve 5 such that the ink supply path 9 is opened, instructs the cap 7 to suck the nozzle, and actuates the pump 10 such that the ink is supplied from the ink supply path 9 to the nozzle via the common flow path 24 until the nozzle is filled with the ink.

In step S140, after a predetermined maintenance operation (for example, wiping using a wiper (not illustrated) and flushing) is completed, an operation of discharging ink onto a medium is started, and thereby the process moves from step S110 to step S150.

The above-described recording operation start processes enables the recording apparatus 1 to open the air release path 22 to discharge the storage liquid once, and replace the storage liquid with the ink, and thereby the replacement efficiency can be increased. Accordingly, when a recording process is performed, negative effects, such as thinning of ink caused by mixing of the ink with the storage liquid can be reduced.

The controller 25 according to the embodiment can execute the liquid discharge process, the cleaning liquid supply process, the cleaning liquid discharge process, and the storage liquid supply process (i.e., from step S160 to step S190) in response to an input of an instruction for turning off the power of the recording apparatus 1. Specifically, while a power button (not illustrated) is pressed and the recording apparatus 1 is moved from the power-on state to a power-off state, before the power supply to the recording apparatus 1 is shut off, the processes in step S160 to step S190 are performed. Consequently, each of the processes (from step S160 to step S190) can be automatically performed, and the user can be prevented from forgetting to issue an instruction to execute these processes.

The recording apparatus 1 according to the embodiment also includes the execution start button 26 that serves as an execution start reception section for starting execution of the liquid discharge step, the cleaning liquid supply step, the cleaning liquid discharge step, and the storage liquid supply step by the controller 25. Accordingly, the user can readily instruct the execution of these processes (from step S160 to step S190) by pressing the execution start button 26 at an appropriate time.

Both of the cleaning liquid and the storage liquid, which are filling liquids according to the embodiment, contain a component contained in the ink. The component can reduce negative effects that may occur when the filling liquid is mixed with the ink.

Figure 5:
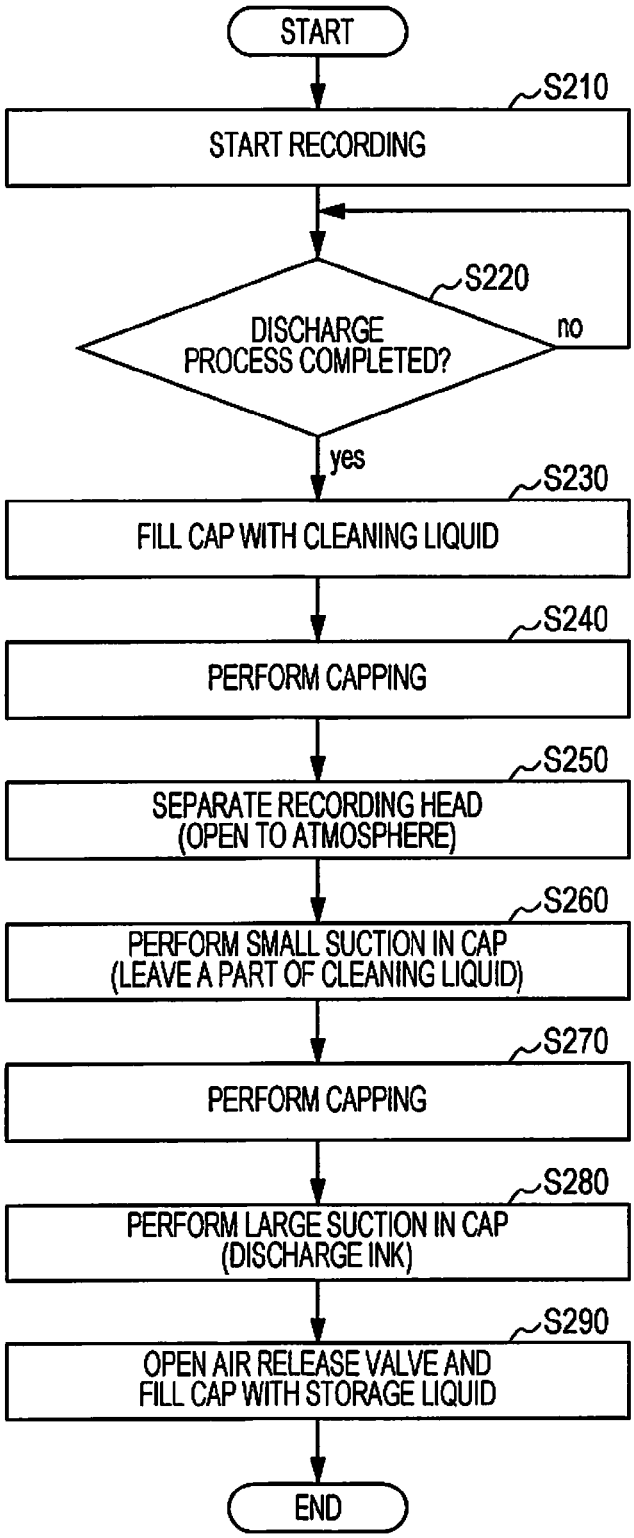
FIG. 5 is a flowchart of a method of storing the recording apparatus according to an embodiment of the invention.

Now, a method according to another embodiment for capping the recording apparatus 1 according to the above-described embodiment, the method being different from the above-described storage method, will be described. FIG. 5 is a flowchart of the capping method according to the embodiment.

First, in step S210, recording data is input by the controller 25 and recording is started. In step S220, a recording operation is performed until the recording (discharge of the ink) according to the recording data is completed. The processes in step S210 and step S220 may be the same as or different from those in step S110 and step S150 in the above-described storage method.

The recording apparatus 1 according to the embodiment includes, similarly to the above-described embodiment, the recording head 6 that discharges an ink from the nozzle onto a medium, the cap 7 that caps the nozzle, the supply path 15 that supplies the filling liquid (the cleaning liquid or the storage liquid) into the cap 7, and the controller 25 that controls the process for capping the nozzle and the filling process of the filling liquid. In response to the completion of the discharge process to the medium by the recording head 6 in step S220, in step S230, the controller 25 controls the pump 16, the opening/closing valve 19, and other components such that the cap is filled with the filling liquid and the cleaning liquid that is the filling liquid comes into contact with the nozzle. In step S240, the nozzle is capped in the state the cap is filled with the filling liquid. The execution of the filling liquid filling capping process in step S230 and step S240 enables the cap to be filled with the filling liquid with an amount and time sufficient to reduce the ink clogging. With this process, ink clogging, especially around the nozzle, can be sufficiently reduced.

Furthermore, as described above, the recording apparatus 1 according to the embodiment includes the discharge path 18 that discharges the liquid in the cap 7, and the air release valve 21 that can cause the interior of the cap 7 to be opened to the atmosphere in a state where the nozzle is capped by the cap 7. After the completion of step S230 and step S240, in the air release process in step S250, the controller 25 controls the recording head 6 and the cap 7 such that the recording head 6 and the cap 7 are separated from each other to release air in the cap 7. In the filling liquid discharge process in step S260, the cleaning liquid in the cap 7 is discharged from the discharge path 18. The process to allow air in the cap 7 to be released in step S250 prevents the ink from running from the nozzle (a large amount of ink is mixed with the cleaning liquid and thereby the cleaning power is decreased), and in step S260, the cleaning liquid (the large amount of cleaning liquid filled in the cap 7) filled in the cap 7 is discharged into the discharge path 18. Accordingly, ink clogging, especially in the discharge path 18, can be sufficiently reduced. It should be noted that, in step S250, the air release valve 21 may be opened instead of separating the recording head 6 and the cap 7.

In step S260, the controller 25 leaves a part of the cleaning liquid in the cap 7 (adjusts the actuation of the pump 23 to perform small suction such that a small amount of liquid remains in the cap 7). After the process in step S260 is completed, in the capping process in step S270, the nozzle is capped by the cap 7. In the ink discharge process in step S280, the controller 25 closes the air release valve 21, and discharges the ink in the nozzle together with the cleaning liquid that remains in the cap 7 from the discharge path 18 (adjusts the actuation of the pump 23 to perform large suction such that an amount of liquid larger than that of the small suction is to be sucked). As described above, while the decrease (mixing of the ink into the cleaning liquid) in the cleaning power caused by the cleaning liquid can be reduced in step S260, the ink clogging in the discharge path 18 and other parts can be sufficiently reduced. Furthermore, the process in step S280 is performed while the cleaning liquid is partly left in the cap 7 to mix the ink and the cleaning liquid (the ink that causes ink clogging in the discharge path 18 and other parts is thinned) such that the liquid that flows in the discharge path 18 is to be the mixture of the ink and the cleaning liquid to reduce the ink clogging in the discharge path 18 and other parts by the process in step S280.

As mentioned above, the filling liquid used in the recording apparatus 1 according to the embodiment includes the cleaning liquid and the storage liquid that is less volatile than the cleaning liquid. After the completion of the process in step S280, while the controller 25 controls the pump 16 and the opening/closing valve 20, the controller 25 opens the air release valve 21 such that the cap 7 is filled with the storage liquid. With this process, the capping method according to the embodiment ends. In other words, first, the controller 25 perform the filling liquid filling capping process (step S230) using the cleaning liquid, discharges the cleaning liquid in the cap 7 (step S260), and then, performs the filling liquid filling capping process (step S290) using the storage liquid. Accordingly, ink clogging can be effectively cleaned by the cleaning liquid that has the strong cleaning power while the inside of the cap 7 can be effectively moisturized by the less volatile storage liquid and stored.

It should be noted that the controller 25 can supply the filling liquid (the cleaning liquid or the storage liquid) until the filling liquid spills from the cap 7 when the nozzle is capped in the filling liquid filling capping process (step S230 and step S290). This spilled filling liquid cleans portions other than the capped portion in the recording head 6, such as portions of the recording head 6 other than the nozzle formation surface.

The recording apparatus 1 according to the embodiment includes the supply path 15 and the discharge path 18, which are provided separately from each other, as illustrated in FIG. 1. This structure prevents the ink components (ink contamination such as deposits of solid materials contained in the ink) that remains in the discharge path 18 from being supplied (backflow) into the cap 7.

It is to be understood that the present invention is not limited to the above-described embodiments, various modifications can be made within the scope of the following claims, and these modifications are included within the scope of the invention.

This application claims priority under 35 U.S.C. § 119 to Japanese Patent Application No. 2016-008074, filed Jan. 19, 2016. The entire disclosure of Japanese Patent Application No. 2016-008074 is hereby incorporated herein by reference.

What is claimed is:

1. A recording apparatus comprising:

a discharge section configured to discharge an ink from a nozzle onto a medium;

a common flow path configured to supply a liquid to the nozzle;

an ink supply path configured to supply the ink to the common flow path;

a filling liquid supply path configured to supply a filling liquid to the common flow path;

an air release path configured to release air in the common flow path; and a switching section configured to switch between the opening and closing of the ink supply path, the filling liquid supply path, and the air release path, wherein the air release path is opened by the switching section and the nozzle is sucked in a state in which the air release path is opened to discharge the liquid from the common flow path via the nozzle.

2. The recording apparatus according to claim 1, wherein a cleaning liquid supply path for a cleaning liquid and a storage liquid supply path for a storage liquid are provided as the filling liquid supply path.

3. The recording apparatus according to claim 2, further comprising:

a cap configured to cap and suck the nozzle; and a controller configured to control the supply of the liquid to the common flow path and the capping and suction of the nozzle, wherein the controller performs a liquid discharge process of opening the air release path, sucking the nozzle with the cap, and discharging the liquid from the common flow path;

a cleaning liquid supply process of closing the air release path, opening the cleaning liquid supply path, and supplying the cleaning liquid from the cleaning liquid supply path to the nozzle through the common flow path until the nozzle is filled with the cleaning liquid;

a cleaning liquid discharge process of opening the air release path, sucking the nozzle with the cap, and discharging the cleaning liquid from the common flow path; and a storage liquid supply process of closing the air release path, opening the storage liquid supply path, and supplying the storage liquid from the storage liquid supply path to the nozzle through the common flow path until the nozzle is filled with the storage liquid.

4. The recording apparatus according to claim 3, wherein the controller performs, in response to a recording start after the execution of the storage liquid supply process, a storage liquid discharge process of opening the air release path, sucking the nozzle with the cap, and discharging the storage liquid from the common flow path; and an ink supply process of closing the air release path, opening the ink supply path, and supplying the ink from the ink supply path to the nozzle through the common flow path until the nozzle is filled with the ink.

5. The recording apparatus according to claim 3, wherein the controller performs the liquid discharge process, the cleaning liquid supply process, the cleaning liquid discharge process, and the storage liquid supply process, in response to an input of an instruction to turn off the power of the recording apparatus.

6. The recording apparatus according to claim 3, further comprising:

an execution start reception section configured to start the execution of the liquid discharge process, the cleaning liquid supply process, the cleaning liquid discharge process, and the storage liquid supply process by the controller.

7. The recording apparatus according to claim 1, wherein the filling liquid contains a component contained in the ink.

8. A method of storing a recording apparatus including a discharge section configured to discharge an ink from a nozzle onto a medium, a common flow path configured to supply a liquid to the nozzle, an ink supply path configured to supply the ink to the common flow path, a filling liquid supply path configured to supply a filling liquid to the common flow path, an air release path configured to release air in the common flow path, a switching section configured to switch between the opening and closing of the ink supply path, the filling liquid supply path, and the air release path, and a cap configured to cap and suck the nozzle, the method comprising:

a liquid discharge process of opening the air release path, sucking the nozzle with the cap, and discharging the liquid from the common flow path;

a cleaning liquid supply process of closing the air release path, opening the cleaning liquid supply path, and supplying the cleaning liquid from the cleaning liquid supply path to the nozzle through the common flow path until the nozzle is filled with the cleaning liquid;

a cleaning liquid discharge process of opening the air release path, sucking the nozzle with the cap, and discharging the cleaning liquid from the common flow path; and a storage liquid supply process of closing the air release path, opening the storage liquid supply path, and supplying the storage liquid from the storage liquid supply path to the nozzle through the common flow path until the nozzle is filled with the storage liquid.

* * * * *